US009254002B2

(12) United States Patent
Chong et al.

(10) Patent No.: US 9,254,002 B2
(45) Date of Patent: Feb. 9, 2016

(54) TOBACCO SOLUTION FOR VAPORIZED INHALATION

(71) Applicant: Chong Corporation, Minneapolis, MN (US)

(72) Inventors: Alexander ChinHak Chong, St. Louis Park, MN (US); William Bartkoswki, Edina, MI (US); Marshall Thompson, Camarillo, CA (US)

(73) Assignee: CHONG CORPORATION, Minneapolis, MN (US)

( * ) Notice: Subject to any disclaimer, the term of this patent is extended or adjusted under 35 U.S.C. 154(b) by 396 days.

(21) Appl. No.: 13/846,617

(22) Filed: Mar. 18, 2013

(65) Prior Publication Data

US 2013/0213417 A1 Aug. 22, 2013

Related U.S. Application Data

(63) Continuation-in-part of application No. 12/858,373, filed on Aug. 17, 2010, now abandoned.

(60) Provisional application No. 61/234,560, filed on Aug. 17, 2009.

(51) Int. Cl.

| | |
|---|---|
| ***A24F 47/00*** | (2006.01) |
| ***A24B 15/30*** | (2006.01) |
| ***A24B 15/18*** | (2006.01) |
| ***A24B 15/24*** | (2006.01) |

(52) U.S. Cl.
CPC ..... *A24B 15/30* (2013.01); *A24B 15/18* (2013.01); *A24B 15/24* (2013.01); *A24F 47/004* (2013.01)

(58) Field of Classification Search
CPC ..... A24F 47/00
USPC ..... 131/310
See application file for complete search history.

(56) References Cited

U.S. PATENT DOCUMENTS

| | | | | |
|---|---|---|---|---|
| 5,080,114 | A | 1/1992 | Rudolph et al. | |
| 5,095,921 | A | 3/1992 | Losse et al. | |
| 5,234,008 | A | 8/1993 | Fagg | |
| 5,240,016 | A | 8/1993 | Nichols et al. | |
| 5,322,075 | A | 6/1994 | Deevi et al. | |
| 5,486,362 | A | 1/1996 | Kitchell et al. | |
| 5,666,978 | A | 9/1997 | Counts et al. | |
| 6,040,560 | A | 3/2000 | Fleischlauer et al. | |
| 6,513,524 | B1 | 2/2003 | Storz | |
| 6,532,965 | B1 | 3/2003 | Abhulimen et al. | |
| 7,726,320 | B2 | 6/2010 | Robinson et al. | |
| 2004/0031495 | A1 | 2/2004 | Steinberg | |
| 2006/0191548 | A1* | 8/2006 | Strickland et al. | 131/347 |
| 2006/0204598 | A1 | 9/2006 | Thompson | |
| 2007/0280652 | A1 | 12/2007 | Williams | |
| 2008/0060663 | A1 | 3/2008 | Hamade et al. | |
| 2008/0092912 | A1 | 4/2008 | Robinson et al. | |
| 2008/0108710 | A1* | 5/2008 | Prakash et al. | 514/783 |
| 2008/0166303 | A1 | 7/2008 | Tamarkin et al. | |
| 2008/0173300 | A1 | 7/2008 | Justman | |
| 2008/0209586 | A1* | 8/2008 | Nielsen et al. | 800/270 |
| 2008/0241255 | A1 | 10/2008 | Rose et al. | |
| 2008/0257367 | A1 | 10/2008 | Paterno et al. | |
| 2009/0095313 | A1* | 4/2009 | Fuisz | 131/290 |
| 2009/0118331 | A1 | 5/2009 | Crooks et al. | |
| 2009/0253754 | A1* | 10/2009 | Selmin et al. | 514/343 |
| 2009/0301505 | A1* | 12/2009 | Liu et al. | 131/274 |
| 2010/0037903 | A1 | 2/2010 | Coleman, III et al. | |
| 2010/0200006 | A1 | 8/2010 | Robinson et al. | |
| 2010/0200008 | A1 | 8/2010 | Taieb | |

FOREIGN PATENT DOCUMENTS

| | | |
|---|---|---|
| JP | 60009462 | 1/1985 |
| WO | WO 03/034847 | 5/2003 |

OTHER PUBLICATIONS

Wikipedia_Lobelia, Last modified Feb. 28, 2012, Retrieved from the Internet: <http://en.wikipedia.org/wiki/Lobelia>.

Chinese Patent Office, International Search Report for PCT/CN2004/000182, dated Jun. 10, 2004.

Karin Gulilem et al., "Monoamine Oxidase Inhibition Dramatically Increases the Motivation to Self-Administer Nicotine in Rats", The Journal of Neuroscience, Sep. 21, 2005, 25(38):8593-8600.

* cited by examiner

*Primary Examiner* — Matthew Daniels
*Assistant Examiner* — Cynthia Szewczyk
(74) *Attorney, Agent, or Firm* — Cislo & Thomas, LLP

(57) ABSTRACT

A tobacco solution containing water; a polysorbate compound; and an effective serving of tobacco constituents for vaporizing the tobacco solution for inhalation. The tobacco constituents may include nicotine, monoamine oxidase inhibitor, tobacco flavor, and tobacco aroma derived from tobacco.

21 Claims, No Drawings

TOBACCO SOLUTION FOR VAPORIZED INHALATION

CROSS-REFERENCES TO RELATED APPLICATIONS

This patent application is a continuation-in-part of U.S. patent application Ser. No. 12/858,373 filed on Aug. 17, 2010, which claims the benefit of U.S. Provisional Patent Application No. 61/234,560, filed Aug. 17, 2009, which applications are incorporated here in their entirety by this reference.

TECHNICAL FIELD

This invention relates to tobacco formulations for vaporization for inhalation delivery at low temperatures.

BACKGROUND

Smokers of traditional tobacco products, for example, cigarettes, cigars and pipes, are finding that their use of these products has been significantly and seriously curtailed by smoking regulations passed and enacted due to concerns about the public health dangers of second hand smoke, and potentially harmful chemicals found in the smoke, including tar and carbon monoxide.

In addition to traditional tobacco alternatives to those that must be ignited, cigarettes, cigars ad pipes, like snuff, snus, chewing tobacco, tobacco tablets, tobacco lozenges and tobacco strips, smokers recently have also be utilizing electronic nicotine delivery devices or e-cigarettes.

These products vaporize nicotine, allowing a smoker to inhale a nicotine-infused vapor in a manner similar to smoking.

However, nicotine is just one constituent of tobacco that provides satisfaction to smokers. There are a number of others—actual tobacco flavor, aroma, and monoamine oxidase inhibitors.

Monoamine oxidase inhibitors ("MAOIs") are naturally found in tobacco and naturally occur in tobacco smoke. These naturally occurring tobacco constituents are also used in antidepressants and are widely acknowledged to be mood elevators.

While there have been inventions that teach as to using actual leaf tobacco in certain combinations that then vaporize the constituents without ignition, they combine tobacco in certain and specific forms with solutions that require heating to a temperature range of at least 200 degrees C.

As used in this application, a "first solution" is a solution prior to its contact with tobacco to form a "tobacco solution." In some circumstances, a first solution may have had previous tobacco contact, but will eventually have subsequent tobacco contact to form a "tobacco solution."

Vaporization at 200 degrees C. represents a relatively low temperature compared to other current e-cigarettes, but there are compelling reasons for seeking first solutions and other solutions that vaporize at much lower temperatures. These reasons include a) minimizing power needs to reach temperatures of less than 200 degrees C., allowing for safer and more efficiently powered devices; and, b) using first solutions comprised of smaller molecules, allowing for deeper lung penetration upon inhalation and more efficacious absorption of the tobacco constituents, which, in turn, will allow for more efficient use of tobacco and its constituents—which would be beneficial and desirable should governmental authorities determine that e-cigarettes need to be limited with respect to the volume of tobacco or the density of nicotine and/or other constituents provided in a commercially-available product/device. Those potential limitations notwithstanding, low temperature vaporization of tobacco formulations using first solutions with smaller molecules than currently being utilized and vaporization points well under 200 degrees C. will prove to be more effective and efficacious with respect to providing a safer alternative to the public health risks associated with traditional tobacco products intended to be ignited and smoked.

Accordingly, there is a need in the art for a more effective and safer tobacco delivery mechanism and method of use that provides for vaporization at temperatures well under 200 degrees C. and, ideally, at no more than 100 degrees C.

SUMMARY

In one embodiment of the present invention a method for tobacco delivery is provided comprising: providing tobacco; providing a first solution; contacting the tobacco with the first solution to form a tobacco solution comprising tobacco constituents; and vaporizing the tobacco solution. In other aspects of this embodiment the step of vaporizing the tobacco solution comprises using a piezoelectric element to atomize the tobacco solution without the addition of heat and the tobacco constituents comprise nicotine and at least one monoamine oxidase inhibitor derived from tobacco. In another aspect of this embodiment, the step of vaporizing the tobacco solution comprises using a low temperature vaporizer to vaporize the tobacco solution and the tobacco constituents comprise nicotine and at least one monoamine oxidase inhibitor derived from tobacco.

In another embodiment of the present invention a tobacco solution for use in a vaporization delivery mechanism is provided comprising: water; alcohol; propylene glycol; and tobacco constituents. In one aspect of this embodiment the tobacco constituents comprise nicotine and at least one monoamine oxidase inhibitor derived from tobacco.

In another embodiment of the present invention a device for tobacco delivery is provided comprising: a first solution reservoir comprising a first solution; tobacco; a vaporization mechanism, wherein the solution is contacted with the tobacco to form a tobacco solution comprising tobacco constituents, and wherein the tobacco solution is then provided to the vaporization mechanism. In one aspect of this embodiment the vaporization mechanism comprises a piezoelectric element to atomize the tobacco solution without the addition of heat. In another aspect of this embodiment the vaporization mechanism comprises a low temperature element to vaporize the tobacco solution at a low temperature. In another aspect of this embodiment the tobacco constituents comprise nicotine and at least one monoamine oxidase inhibitor derived from tobacco.

In another embodiment of the present invention, a tobacco solution is provided prepared by a process comprising the steps of: providing tobacco; providing a first solution comprising water, alcohol, and propylene glycol; contacting the first solution with the tobacco to form a tobacco solution comprising tobacco constituents. In one aspect of this embodiment, the step of contacting the first solution with the tobacco to form a tobacco solution comprises immersing the tobacco in the first solution for a time sufficient to extract the tobacco constituents from the tobacco. In another aspect of this embodiment, the tobacco constituents comprise nicotine and at least one monoamine oxidase inhibitor derived from tobacco. In another aspect of this embodiment, the first solution further comprises glycerin.

In another embodiment of the present invention, the alcohol, polypropylene glycol, and/or glycerin from the tobacco solution are replaced with one or more of the polysorbate family of compounds—polysorbate 20 (polyoxyethylene sorbitan monolaurate), polysorbate 40 (polyoxyethylene (20) sorbitan monopalmitate), polysorbate 60 (polyoxyethylene sorbitan monostearate) and polysorbate 80 (polyoxyethylene sorbitan monooleate.) All members of the polysorbate family have much smaller molecules than those of other well-known excipients in e-cigarettes—propylene glycol, vegetable glycerin, etc. Additionally, all members of the family have vaporization temperatures (boiling points) at 100 degrees C. and flash points at 137 degrees C. Current technology in e-cigarette devices, using their method of vaporization and a power source that is essentially uncontrolled, i.e. lithium chemistry, by external forces-controlled, rather than by battery capacity and state of charge, do not have the ability to limit the heat of the vaporizing element to 100 degree C. and will always run the risk of heating the solution well past the flash point of 137 degrees C., thereby essentially breaking the molecule and causing fundamental molecular changes in the excipient and in the solution. Additionally, the vapor molecule of the polysorbate is much smaller than that of propylene glycol and vegetable glycerin and, in theory, should be able to achieve deeper lung penetration than those excipients, requiring a smaller amount of active ingredients—tobacco constituents—to achieve efficacious results.

Other features and advantages of the present invention will become apparent from the following detailed description. It should be understood, however, that the detailed description and the specific examples, while indicating the preferred embodiments of the present invention, are given by way of illustration only, since various changes and modifications within the spirit and scope of the present invention will become apparent to those skilled in the art from this detailed description.

DETAILED DESCRIPTION OF THE INVENTION

In order to fully understand the manner in which the above-recited details and other advantages and objects according to the invention are obtained, a more detailed description of the invention will be rendered by reference to specific embodiments thereof.

In one embodiment of the present invention, a tobacco delivery method is provided comprising immersing fibrous tobacco in a solution such that the constituents of the tobacco will leach into the solution. The solution is then vaporized by conventional vaporization mechanisms and inhaled by the user.

Said embodiment can be configured to deliver an effective serving of desired tobacco constituents to a user. As used herein, desired tobacco constituent means one or more of tobacco flavor, aroma, monoamine oxidase inhibitors, and nicotine. While an effective serving of tobacco constituents may vary depending upon the particular physiology of the user, for example, the user's weight or body make-up, as used herein, the phrase means an amount sufficient such that the user experiences the intended positive effects experienced when tobacco constituents are delivered through other known methods, such as smoking. For example, one activation of a device used with the current method can deliver the equivalent desired tobacco constituents from one puff from a typical tobacco cigarette. In other embodiments, one activation may be configured to deliver 1, 2, 3, 4, 5, 10, 20, 30, 40, 50, 60, 70, 80, or 90 percent of the desired tobacco constituents from one puff of a tobacco cigarette. Such embodiments are described as delivering a percentage of the effect serving of one or more desired tobacco constituents. In one aspect of this embodiment, the method delvers a specified percentage, e.g., 1, 2, 3, 4, 5, 10, 20, 30, 40, 50, 60, 70, 80, or 90 percent, of tobacco flavor, aroma, monoamine oxidase inhibitors, nicotine, or any other target constituent or combination thereof, in a single serving. In one aspect of this embodiment the effective serving or portion thereof can be delivered in as little as one activation by the user, and in other aspects the effective serving or portion thereof may be delivered through multiple activations by the user over 1, 2, 3, 4, 5, 6, 7, 8, 9, 10 or more minutes of use in a manner similar to the use associated smoking a tobacco product such as a cigarette, cigar or pipe.

Alternatively, the effective serving or portion thereof can be delivered over a specified number of activations by the user. Further, the number of activations can occur over a specified time period. For example, delivery of an effective serving or portion thereof can be provided with 1, 2, 3, 4, 5, 6, 7, 8, 9, 10, 11, 12, 13, 14, 15, 16, 17, 18, 19, or 20 activations. For example, the effective serving or portion thereof may be delivered in 1-20 activations, 5-15 activations, 12-20, activations, 12-18 activations or about 15 activations, any of which can occur in a 1, 2, 3, 4, 5, 6, 7, 8, 9, 10, or 20 minute period. Some embodiments will be formulated and/or configured such that the effective serving or portion thereof is delivered as quickly as possible, and other embodiments can be formulated and/or configured such that the effective serving or portion thereof is delivered in about the same time and manner as if one was smoking a typical tobacco cigarette to simulate a typical smoking experience.

In various embodiments, an effective serving or portion thereof may be delivered in less than 50 activations, about 1-50 activations, about 1-20 activations, 5-15 activations or about 8-10 activations. The effective serving or portion of tobacco constituents may include approximately 0.5 mg or more, between about 0.5 to about 100 mg, between about 0.5 to about 50 mg, between about 0.5 to about 20 mg, between about 0.5 to about 10 mg, between about 5 to about 10 mg, or about 5 mg of tobacco solution. Relative to the other components in the tobacco solution, the tobacco constituents may comprise at least 0.5% of the tobacco solution. A suitable range for the tobacco constituents may be about 0.5% to about 99.5% of the tobacco solution. In some embodiments the tobacco solution may comprise about 0.5% to about 50% of the tobacco constituents. Preferably, the tobacco constituents are present at about 0.5% to about 20% of the tobacco solution. More preferably, the tobacco constituents are present at about 0.5% to about 10% of the tobacco solution. Most preferably, the tobacco constituents are present at about 5% of the tobacco solution.

The solution may be any solution sufficient to allow the constituents of the tobacco to leach or be extracted into the solution upon contact with the fibrous tobacco for a specified time period to form a tobacco solution. Examples of suitable solutions include one or more of water, alcohol, and an inert non-reactive compound, for example propylene glycol. The solution can comprise about 0.01% to about 20% water, about 2% to about 18% water, about 5% to about 15% water, or about 10% water; about 0.01% to about 20% alcohol, about 2% to about 18% alcohol, about 5 to about 15% alcohol, or about 10% alcohol, with the balance being propylene glycol. In another aspect of this embodiment, the solution further comprises glycerin, including from about 1% to about 30%, about 5 to about 20%, about 5% to about 10%, or about 10% to about 15% glycerin.

Without being limited by theory, it is believed that the addition of glycerin provides a more robust vapor upon vaporization of the product and promotes the extraction or leaching of nicotine and other desirable components from the tobacco.

To promote the leaching or extracting of the constituents of the tobacco into the solution, various methods may be employed to contact the tobacco with the solution, including maximizing the surface area of the tobacco. In one embodiment the fibrous tobacco is formed in the shape of a mesh screen through which the solution is passed. In other configurations, the tobacco is formed to provide the maximum surface area for contact with the solution yet still allow flow of the solution through the fibrous tobacco and into a vaporization mechanism. Examples of other configurations for use in maximizing the surface area of the fibrous tobacco for contact with a solution include spirally wound tobacco, tobacco pellets, tobacco powder, or encapsulating the tobacco in a porous, filter-like material, which will allow the solution to flow through the tobacco-encapsulate and the constituents of the tobacco to leach into the solution. Leaching and/or extracting may also be promoted through modifying the temperature of the solution or the pressure under which the solution is contacted with the tobacco.

In some embodiments the solution and the tobacco are contacted immediately prior to vaporization. In other embodiments the solution and tobacco can be contacted over an extended period of time prior to vaporization. For example, the tobacco can be provided immersed in the solution such that the solution has been in contact with the tobacco for an extended period of time prior to vaporization. In said examples, the leaching or extraction of the tobacco constituents can be promoted by varying the conditions or other parameters during contact of the solution with the tobacco. The tobacco can be removed or substantially removed from the solution prior to providing the solution to the end consumer for inclusion in a device for vaporization, or immediately prior to vaporization by draining the solution from the tobacco.

The solution is then vaporized for inhalation by the user. One example of a mechanism that may be used to vaporize the solution is disclosed in U.S. patent application Ser. Nos. 10/587,707 and 10/547,244, incorporated herein by reference. Other mechanisms may be used including atomizers or other vaporizers known in the art. Vaporization or atomization can be performed with or without the addition of heat to the solution. In one aspect a low temperature vaporizer is provided, including vaporization at temperatures from about 180 degree C. to about 280 degree C., from about 180 degree C. to about 250 degree C., from about 180 degree C. to about 225 degree C., from about 180 degree C. to about 200 degree C., wherein the temperature indicates the temperature at which the solution is vaporized. It is understood that the temperature of the vaporization element may be higher.

In some embodiments, in order to achieve a lower temperature of vaporization the propylene glycol, alcohol, and/or glycerin in the tobacco solution may be substituted with a compound from the polysorbate class or family, such as polysorbate 20 (polyoxyethylene sorbitan monolaurate), polysorbate 40 (polyoxyethylene (20) sorbitan monopalmitate), polysorbate 60 (polyoxyethylene sorbitan monostearate), and polysorbate 80 (polyoxyethylene sorbitan monooleate.). Therefore, in some embodiments, the tobacco solution may comprise water, tobacco constituents, and polysorbate. The process for making this tobacco solution may be the same as discussed for previous embodiments using propylene glycol and alcohol discussed above and incorporated here by this reference.

Preferably, the tobacco solution comprises about 0.01% to about 20% water. More preferably, the tobacco solution comprises about 2% to about 18% water. Even more preferably the tobacco solution comprises about 5% to about 15% water. In the most preferred embodiment, the tobacco solution comprises about 10% water.

In tobacco solutions using polysorbates, the effective serving or portion of tobacco constituents may be approximately 0.5% or more of the tobacco solution. An acceptable range of tobacco constituents in the tobacco solution ranges from about 0.5% to about 99% or about 0.5% to about 50% of the tobacco solution. A tobacco solution comprising about 0.5% to about 20% tobacco constituents is also acceptable. Preferably, the tobacco solution comprises between about 0.5% to about 15% tobacco constituents. More preferably, the tobacco solution comprises about 5% to about 10% tobacco constituents. Most preferably, the tobacco solution comprises about 5% tobacco constituents.

The polysorbates make up the remainder of the tobacco solution. Therefore, the tobacco solution can comprise up to 99.5% of polysorbate. The polysorbate may be polysorbate 20, polysorbate 40, polysorbate 60, polysorbate 80, or a polysorbate composition comprising any combination thereof. The type of polysorbate used or the combination of polysorbates used depends on the intended effect desired as the different polysorbates offer different attributes due to the different molecule sizes of the different polysorbate. For example, the polysorbate molecules increase in size from polysorbate 20 to polysorbate 80. There is a sliding scale effect of vapor amount or density and lung penetration with increasing size of polysorbate molecules. Using smaller size polysorbate molecules creates less of a vapor, but permits deeper lung penetration. This may be desirable when the user is out in public where he would not want to create a large plume of "smoke" (i.e. vapors). This effect can be achieved, for example, if the polysorbate composition comprises about 70% to about 100% polysorbate 20.

Conversely, if a dense vapor is desired, which can convey the aromatic constituents of tobacco, then the larger polysorbate molecules can predominate the polysorbate composition used in the tobacco solution. For example, the polysorbate composition may comprise about 70% to about 100% polysorbate 80. Therefore, characteristics, features, and attributes of the tobacco solution and the resultant vapor can be controlled by using a polysorbate composition with a specific combination of polysorbate 20, polysorbate 40, polysorbate 60, and/or polysorbate 80.

An additional benefit of using the polysorbate family of compounds as a substitute for the propylene glycol, alcohol, and/or glycerin is that the polysorbates lower the heat of vaporization of the tobacco solution. Most electronic cigarettes require at least 200 degrees C. to vaporize the tobacco solution. Using polysorbates in the tobacco solution can bring the heat of vaporization down to less than 200 degrees C. Preferably, the heat of vaporization of the tobacco solution comprising polysorbate is 100 degrees C. or less.

In another embodiment, a device for implementing the tobacco delivery methods set forth herein is provided comprising a shell, a mouthpiece, an air inlet provided on the external wall of the shell; a cell, an electronic circuit board, a normal pressure cavity, a sensor, an atomizer, a solution reservoir; a tobacco reservoir, a solution stream passage, a negative pressure cavity provided in the sensor, an atomization cavity arranged in the atomizer, and an aerosol passage, wherein the solution reservoir is in contact with the tobacco reservoir and the atomizer, and the air inlet, normal pressure cavity, atomizer, aerosol passage, gas vent and mouthpiece are interconnected.

In another embodiment, a device for implementing the tobacco delivery methods set forth herein is provided comprising a shell, a mouthpiece, an air inlet provided on the external wall of the shell; a cell, an electronic circuit board, a normal pressure cavity, a sensor, an atomizer, a solution reservoir; a solution stream passage, a negative pressure cavity provided in the sensor, an atomization cavity arranged in the atomizer, and an aerosol passage, wherein the solution reservoir is in contact with the atomizer, and the air inlet, normal pressure cavity, atomizer, aerosol passage, gas vent and mouthpiece are interconnected. The solution reservoir may be configured to retain solution and tobacco, or solution that has previous been contacted with tobacco.

In some embodiments the device is provided in the configuration of a cigar or cigarette. In other embodiments the device is provided in other configurations such that the device can be readily distinguished from a cigar or cigarette.

In some embodiments, the delivery device is a hand-held, personal, portable device that is disposable. Moreover, in some embodiments the method of vaporization does not use heat, rather it uses piezoelectric elements to atomize the tobacco solution.

Some embodiments provided herein produce a vapor containing the key constituents of tobacco that smokers find most appealing, comforting and satisfying without many of the harmful components created through burning the tobacco.

In another embodiment, a tobacco solution is provided for use in the methods and devices disclosed herein. The tobacco solution comprises actual tobacco constituents, including nicotine, flavor, aroma and MAOIs. The tobacco solution may be formed by contacting a solution as set forth herein with tobacco as set forth herein to form a tobacco solution. The concentration of the actual tobacco constituents of the tobacco solution can be varied by varying the method for making the tobacco solution. For example, one can vary the contact time between the solution and the tobacco, the temperature at which the contact occurs, or the pressure at which the contact occurs. The tobacco solution may be provided with or without tobacco in contact with the tobacco solution.

In another embodiment a disposable cartridge is provided comprising a tobacco solution or tobacco and a first solution as set forth herein. The cartridge can include one or more effective servings of tobacco constituents as set forth herein. In one aspect of this embodiment the cartridge can include between about 5-50 servings, between about 5-25 servings, between about 10-25 servings, between about 10-50 servings, between about 10-20 servings of tobacco constituents.

Accordingly, some embodiments herein provide smokers or other tobacco users with an easy-to-use, convenient tobacco product that will not produce second hand smoke while still delivering key tobacco constituents and effectively replicating traditional tobacco products.

Although the invention has been described with respect to specific embodiments and examples, it will be readily appreciated by those skilled in the art that modifications and adaptations of the invention are possible without deviation from the spirit and scope of the invention. Accordingly, the scope of the present invention is limited only by the following claims.

What is claimed is:

1. A tobacco solution for use in a vaporization delivery mechanism, the tobacco solution comprising:

a. water present at about 0.01% to about 20% of the tobacco solution;

b. an effective serving of tobacco constituents, wherein the effective serving is at least 0.5% of the tobacco solution; and c. a remainder of the tobacco solution comprising at least 70 percent of a polysorbate composition.

2. The tobacco solution of claim 1, wherein the tobacco constituents are selected from the group consisting of nicotine and a monoamine oxidase inhibitor.

3. The tobacco solution of claim 1, wherein the effective serving of the tobacco constituents is between about 0.5% to about 20% of the tobacco solution.

4. The tobacco solution of claim 1, wherein the effective serving of the tobacco constituents is between about 0.5% to about 15% of the tobacco solution.

5. The tobacco solution of claim 1, wherein the effective serving of the tobacco constituents is between about 5% to about 10% of the tobacco solution.

6. The tobacco solution of claim 1, wherein the tobacco solution comprises about 2% to about 18% water.

7. The tobacco solution of claim 1, wherein the tobacco solution comprises about 5% to about 15% water.

8. A tobacco solution for use in a vaporization delivery mechanism, the tobacco solution comprising:

a. water present at about 0.01% to about 20% of the tobacco solution;

b. an effective serving of tobacco constituents, wherein the effective serving is a least 0.5% of the tobacco solution; and c. a remainder of the tobacco solution comprising a polysorbate composition, wherein the polysorbate composition comprises at least 70% polysorbate 20.

9. The tobacco solution of claim 8, wherein the tobacco constituents are selected from the group consisting of nicotine and a monoamine oxidase inhibitor.

10. The tobacco solution of claim 8, wherein the effective serving of the tobacco constituents is between about 0.5% to about 20% of the tobacco solution.

11. The tobacco solution of claim 8, wherein the effective serving of the tobacco constituents is between about 0.5% to about 15% of the tobacco solution.

12. The tobacco solution of claim 8, wherein the effective serving of the tobacco constituents is between about 5% to about 10% of the tobacco solution.

13. The tobacco solution of claim 8, wherein the tobacco solution comprises about 2% to about 18% water.

14. The tobacco solution of claim 8, wherein the tobacco solution comprises about 5% to about 15% water.

15. A tobacco solution for use in a vaporization delivery mechanism, the tobacco solution comprising:

a. water present at about 0.01% to about 20% of the tobacco solution;

b. an effective serving of tobacco constituents, wherein the effective serving is at least 0.5% of the tobacco solution; and c. a remainder of the tobacco solution comprising a polysorbate composition, wherein the polysorbate composition comprises at least 70% polysorbate 80.

16. The tobacco solution of claim 15, wherein the tobacco constituents are selected from the group consisting of nicotine and a monoamine oxidase inhibitor.

17. The tobacco solution of claim 15, wherein the effective serving of the tobacco constituents is between about 0.5% to about 20% of the tobacco solution.

18. The tobacco solution of claim 15, wherein the effective serving of the tobacco constituents is between about 0.5% to about 15% of the tobacco solution.

19. The tobacco solution of claim 15, wherein the effective serving of the tobacco constituents is between about 5% to about 10% of the tobacco solution.

20. The tobacco solution of claim 15, wherein the tobacco solution comprises about 2% to about 18% water.

21. The tobacco solution of claim 15, wherein the tobacco solution comprises about 5% to about 15% water.

* * * * *